US008261519B2

(12) United States Patent
Woods

(10) Patent No.: US 8,261,519 B2
(45) Date of Patent: Sep. 11, 2012

(54) STABILIZING SYSTEM FOR A SADDLE

(76) Inventor: Dana L. Woods, Dundas (CA)

( * ) Notice: Subject to any disclaimer, the term of this patent is extended or adjusted under 35 U.S.C. 154(b) by 190 days.

(21) Appl. No.: 12/761,960

(22) Filed: Apr. 16, 2010

(65) Prior Publication Data

US 2010/0269459 A1 Oct. 28, 2010

Related U.S. Application Data

(60) Provisional application No. 61/172,089, filed on Apr. 23, 2009.

(51) Int. Cl.
*B68C 1/02* (2006.01)
*B68C 1/20* (2006.01)

(52) U.S. Cl. ..... 54/44.1; 54/44.5; 54/23

(58) Field of Classification Search ..... 54/44.1, 54/44.5, 23, 44.7; 36/136
See application file for complete search history.

(56) References Cited

U.S. PATENT DOCUMENTS

| | | | | | |
|---|---|---|---|---|---|
| 558,029 | A | * | 4/1896 | Baur | 54/44.1 |
| 1,397,128 | A | * | 11/1921 | Theodore | 54/44.5 |
| 2,128,159 | A | * | 8/1938 | Morgan | 2/62 |
| 3,873,096 | A | * | 3/1975 | Shoptaugh | 273/156 |
| 4,699,602 | A | * | 10/1987 | Giorgi | 446/124 |
| 4,745,734 | A | | 5/1988 | Brown | |
| 4,799,709 | A | * | 1/1989 | Francois | 280/801.1 |
| 5,107,660 | A | | 4/1992 | Mommeja et al. | |
| 5,226,282 | A | | 7/1993 | Meyers | |
| 5,383,328 | A | | 1/1995 | Brown | |
| 5,423,164 | A | * | 6/1995 | Schneider | 54/44.1 |
| 5,517,808 | A | | 5/1996 | Schleese | |
| 5,799,473 | A | | 9/1998 | Goblet | |
| 5,901,531 | A | * | 5/1999 | Rogers | 54/44.1 |
| 6,263,647 | B1 | | 7/2001 | Walkley | |
| 6,453,653 | B2 | | 9/2002 | Gronberg | |
| 6,523,332 | B1 | | 2/2003 | Erb | |
| 6,920,743 | B2 | | 7/2005 | Harrison | |
| 7,021,037 | B1 | | 4/2006 | Szymas | |
| 2004/0065062 | A1 | | 4/2004 | Harrison | |
| 2004/0216433 | A1 | | 11/2004 | Coffin | |
| 2005/0284112 | A1 | | 12/2005 | Peterson | |
| 2006/0032195 | A1 | | 2/2006 | Mattioni | |

FOREIGN PATENT DOCUMENTS

| | | |
|---|---|---|
| CA | 2482594 | 10/2003 |
| CA | 2498334 | 2/2004 |
| WO | WO03011746 | 2/2003 |
| WO | WO03089367 | 10/2003 |
| WO | WO2004050544 | 6/2004 |
| WO | WO2005082773 | 9/2005 |

* cited by examiner

*Primary Examiner* — Rob Swiatek
*Assistant Examiner* — Kathleen Iwasaki

(57) ABSTRACT

The invention also a stabilizing system to stabilize a rider in the saddle comprising a saddle stabilizer block which can be used alone or in combination with a complementary boot stabilizer block to restrict movement of the rider in the saddle.

9 Claims, 11 Drawing Sheets

Prior Art

Prior Art

STABILIZING SYSTEM FOR A SADDLE

RELATED APPLICATIONS

This applications claims priority from U.S. Provisional Application No. 61/172,089 filed on Apr. 23, 2009, the entirety of which is incorporated herein by reference.

FIELD OF THE INVENTION

The invention relates generally to horseback riding saddles.

BACKGROUND OF THE INVENTION

Horse saddles of the English riding type often have protrusions located on the saddle flaps called blocks. These blocks are typically placed either at the front edge of the saddle, the rear edge of the saddle or both the front and rear edges of the saddle. The blocks are either sewn to the leather of the saddle or are attached with Velcro. The purpose of traditional leg blocks is to prevent the rider's leg from moving too far forwards or too far backwards in the saddle.

Saddle blocks are able to be attached to the front and rear area of a saddle flap but are not able to be attached in the center area of the saddle flap because this is where the strap system that secures the saddle to the horse is located. In English saddles the securing strap is called a girth and circles around the midsection of the horse securing on both sides of the saddle by fixed straps called billets. Depending on the saddle type there can be one or multiple billet straps, these straps are confined to the central location of the saddle flap because the horse's shoulders and grooves behind the elbows are used to keep the saddle from sliding forward.

Traditional leg blocks will deform to a degree when the rider's leg is pressed against the block. Traditional blocks are attached to a leather saddle flap, when force is applied to the traditional leg block the flexible leather saddle flap will also deform. Traditional leather saddle flaps and traditional leg blocks are too pliable to create enough resistance to retard the upward momentum of the rider's leg that is created by the motion of the horse.

It is known that shoulder-hip-heel positioning with the shoulder-hip-heel line being located in the area of the girth is appropriate for multiple riding disciplines, however, this can be difficult to achieve without blocks to guide the rider's legs into the appropriate position.

Horse saddles typically have a weight distributing internal component referred to as a saddle tree. Traditionally, saddle trees are comprised of a relatively solid, usually wooden structure which is used to transfer the weight of the rider evenly over the horse's back. Stirrups are affixed to the saddle tree by a stirrup bar which holds the stirrup strap. The stirrup bar allows the stirrup strap to become dislodged, preventing a fallen rider from being dragged behind the horse. The stirrup bar is not placed in the center of the saddle in the shoulder-hip-heel line and girth area because the stirrup bar will interfere with the rider's inner thigh. Also, the central area of the saddle is less reinforced and is more prone to damage from use; this is why traditionally the stirrup bar is affixed to the front portion of the saddle tree. Forward placement of the stirrup bar encourages sub-optimal rider posture. It is known that shoulder-hip-heel positioning is appropriate for multiple riding disciplines, however, this is difficult to achieve with a forward stirrup attachment.

Furthermore, riders typically experience instability in the saddle coincident with movement of the horse. Instability can be experienced on horses with bouncy or exuberant gaits, in jumping activities, during activities that involve high speeds or activities involving changes in the rate of speed. Improvements in saddles that provided riders with increased security in the saddle and diminished the negative impact of the rider's movements on the horse's back would be of great benefit.

SUMMARY OF THE INVENTION

A saddle stabilizer block for stabilizing a rider in a saddle comprising an attachment means to attach the saddle stabilizer block to the saddle at a position to allow engagement of the saddle stabilizer block with the lower leg of a rider.

A stabilizing system for stabilizing a rider to a saddle comprising at least one saddle stabilizer block attachable to the saddle and a boot stabilizer block attachable to at least one of a boot and a lower leg of a rider, wherein the saddle stabilizer block and the boot stabilizer block engage to stabilize the rider in the saddle.

Preferably, the saddle stabilizer block is attached to the saddle at a location that contains the girth strap system that attaches the saddle to the horse.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

In the following description, numerous specific details are set forth to provide a thorough understanding of the invention.

However, it is understood that the invention may be practiced without these specific details. In other instances, well-known structures and/or processes have not been described or shown in detail in order not to obscure the invention. In the description and drawings, like numerals refer to like structures or and/or processes.

It must be noted that as used herein and in the appended claims, the singular forms "a", "an" and "the" include the plural referents unless the context clearly dictates otherwise. Thus, for example, reference to "a saddle stabilizer block" includes reference to one or more devices and equivalents thereof known to those skilled in the art, and so forth.

Figure 1A:
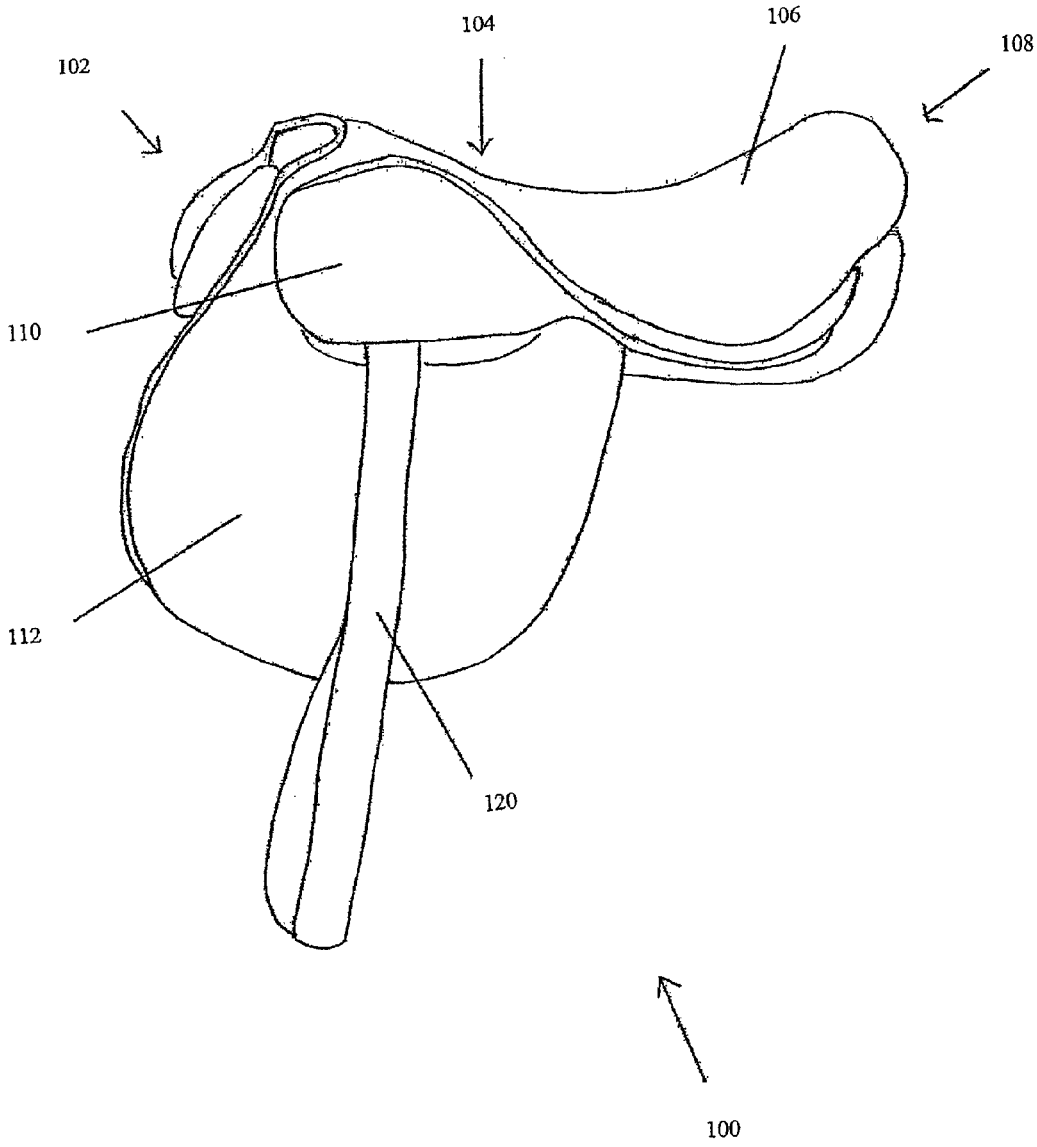
FIG. 1A shows a side elevation view of a traditional English saddle.

FIG. 1A illustrates a traditional English saddle 100, the saddle 100 having a saddle pommel region 102 at a front portion of the saddle 100, a saddle twist region 104 at the most narrow part of the saddle 100 directly behind the saddle pommel region 102, a saddle seat region 106 to accommodate a rider and a saddle cantle region 108 at a rear portion of the saddle 100. A stirrup bar (not shown) is attached to a saddle tree (not shown) and extends from a saddle skirt 110 which covers the saddle tree (not shown). An outer saddle flap 112 is shown extending from underneath the saddle skirt 110. A stirrup leather 120 is shown extending from underneath the saddle skirt 110. The stirrup leather 120 is attached to the saddle 100 by means of the stirrup bar (not visible).

Figure 1B:
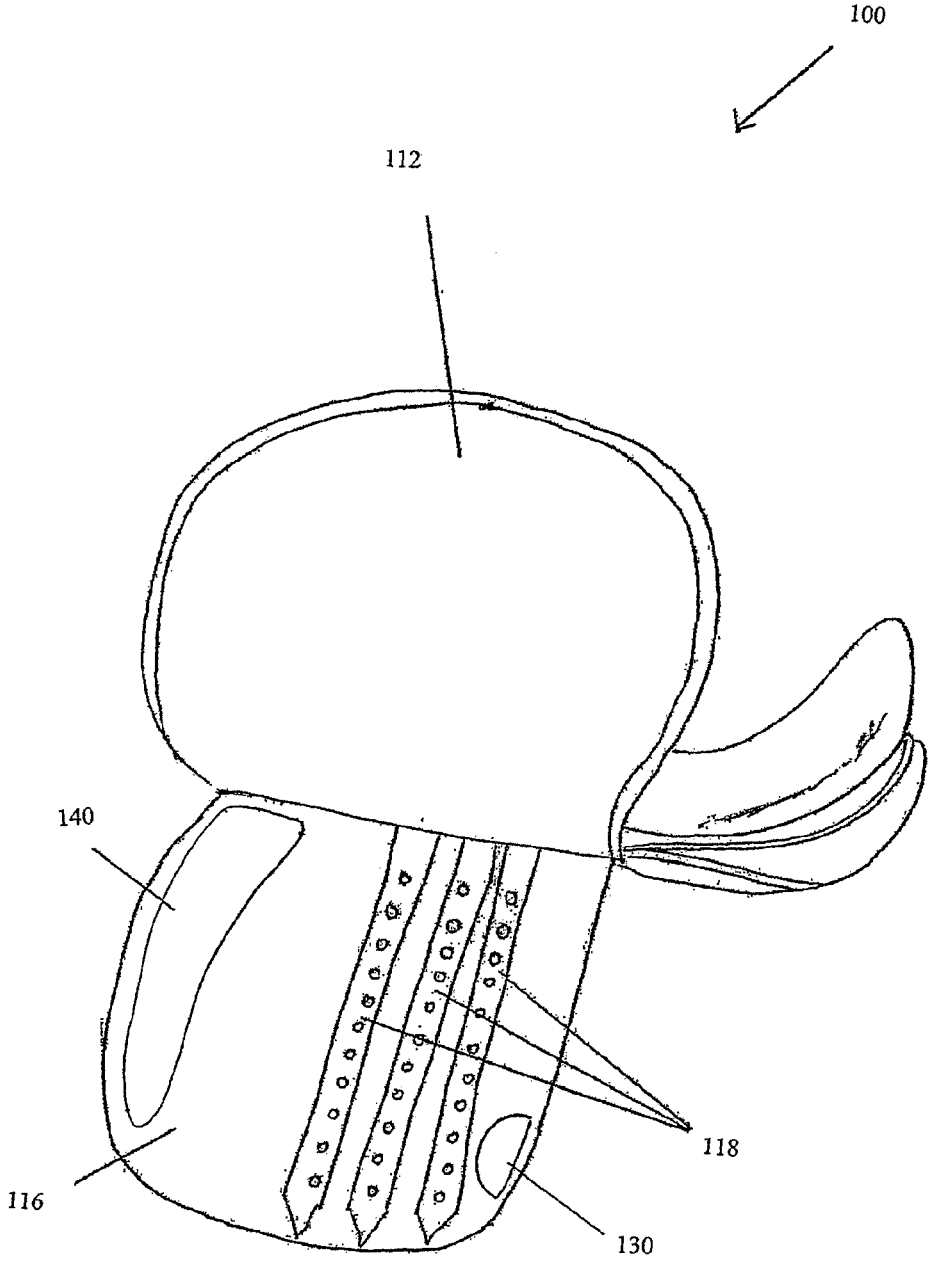
FIG. 1B shows the saddle of FIG. 1A having a saddle flap raised.

FIG. 1B is a side elevation view of the saddle 100 with the outer flap 112 raised exposing the underlying lower flap 116 and girth billets 118 which are attached to the saddle tree (not shown). A traditional front leg block 140 and rear leg block 130 are shown.

Figure 2:
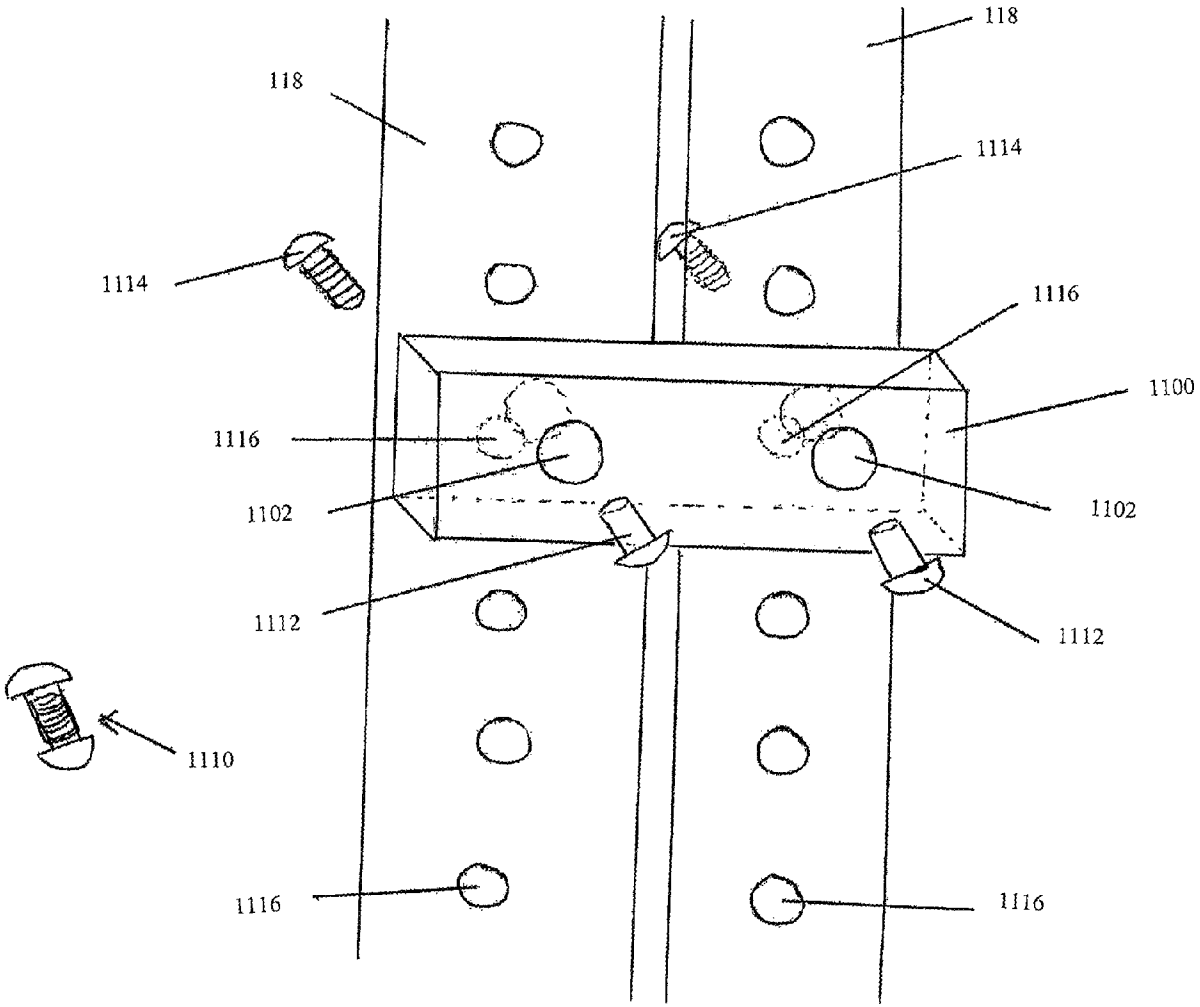
FIG. 2 shows an exploded view of a saddle stabilizer block attached to a pair of girth billets according to another aspect of the saddle of the present invention.

According to an aspect of the invention, a stabilizing system is provided for stabilizing a rider in a saddle. Referring to FIG. 2, a saddle stabilizer block 1100 attached to a pair of girth billets 118 is shown in exploded view. The saddle stabilizer block 1100 has apertures 1102 that extend through the saddle stabilizer block 1100. A Chicago screw 1110 shown in cross section is used to attach the saddle stabilizer block 1100 to the girth billet 118. A female end 1112 of the Chicago screw 1110 is inserted through an aperture 1102 in the saddle stabilizer block 1100. A male end 1114 of the Chicago screw 1110 is inserted through an aperture 1116 in the girth billet 118. In order to secure the saddle stabilizer block 1100 to the girth billet 118, the male end 1114 of the Chicago screw 1110 is securely inserted into the female end 1112 of the Chicago screw 1110. Preferably, the saddle stabilizer block 1100 attaches to at least one aperture 1116 on each the girth billets 118. More preferably, the saddle stabilizer block 1100 has multiple apertures 1102 to enable attachment of the saddle stabilizer block 1100 to each girth billet 118 at multiple points. The above describes an internal version of the saddle stabilizer block 1100 as it is attached directly to the girth billets 118 which are generally located beneath a saddle flap 112. The saddle stabilizer block 1100 is positioned to engage a rider's lower leg, stabilizing the rider in the saddle 100. The saddle stabilizer block 1100 is attached to the girth billets 118 of the saddle 100 by means of weight-bearing fasteners such as Chicago screws 1110. Preferably, the saddle stabilizer block 1100 engages a rider's leg just below the knee.

Figure 3A:
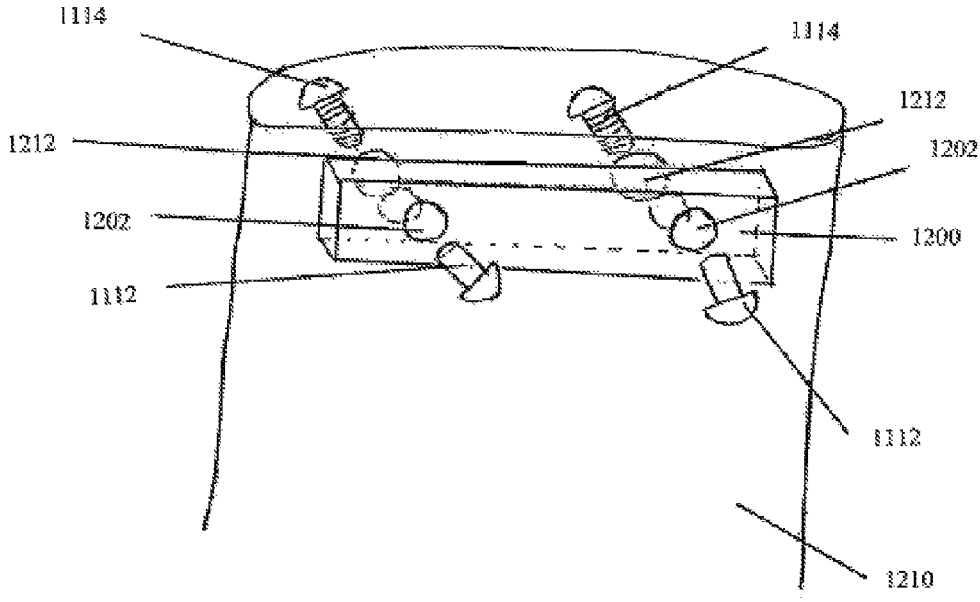
FIG. 3A shows a perspective view of a boot stabilizer block for use with the saddle of the present invention directly attached to a boot.

Although the saddle stabilizer block 1100 may engage a rider's lower leg or a boot 1210 directly, preferably, the stabilizing system includes a corresponding boot stabilizer block. Referring to FIG. 3A, a boot stabilizer block 1200 attached to the boot 1210 is shown in exploded view. A boot stabilizer block aperture 1202 extends through the boot stabilizer block 1200. The female end 1112 of the Chicago screw 1110 is inserted through the boot stabilizer block aperture 1202. The male end 1114 of the Chicago screw 1110 is inserted through a boot aperture 1212. The male end 1114 of the Chicago screw 1110 is securely inserted into the female end 1112 of the Chicago screw to secure the boot stabilizer block 1200 to the boot 1210. Preferably, the boot stabilizer block 1200 attaches to the boot 1210 at least at two points. It would be obvious to a person of skill in the art that more than two points of attachment are possible providing more secure attachment of the boot stabilizer block 1200.

Figure 3B:
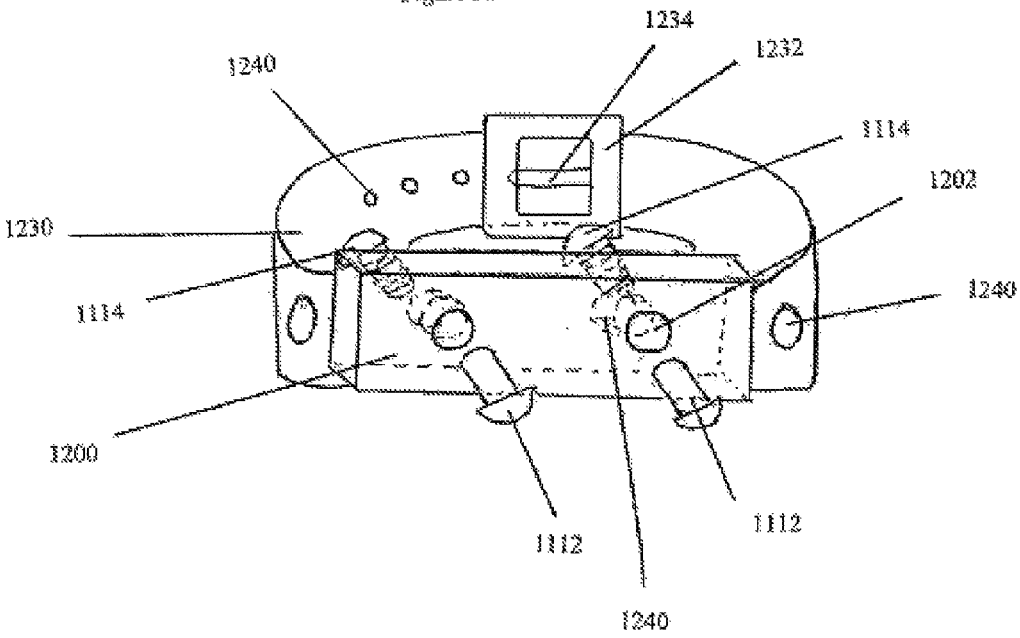
FIG. 3B shows a perspective view of the boot stabilizer block attached to a strap having a buckle for adjustable attachment of the boot stabilizer block to a leg of a rider.

Referring to FIG. 3B, the boot stabilizer block 1200 is attached to a leg strap 1230 having a buckle 1232 for adjustable attachment of the leg strap 1230 to a leg of a rider shown in exploded view. The leg strap 1230 is adjustable where a buckle prong 1234 is insertable into any leg strap aperture 1240. The boot stabilizer block 1200 is attached to the leg strap 1230 by means of the Chicago screw 1110. The female end 1112 of the Chicago screw 1110 is inserted through the boot stabilizer block aperture 1202. The male end 1114 of the Chicago screw 1110 is inserted through the leg strap aperture 1240, securing the boot stabilizer block 1200 to the leg strap 1230. The leg strap 1230 can then be securely attached to the leg of a rider. Preferably, the boot stabilizer block 1200 attaches to the leg strap 1230 at least at two points. It would be obvious to a person of skill in the art that more than two points of attachment are possible.

Figure 3C:
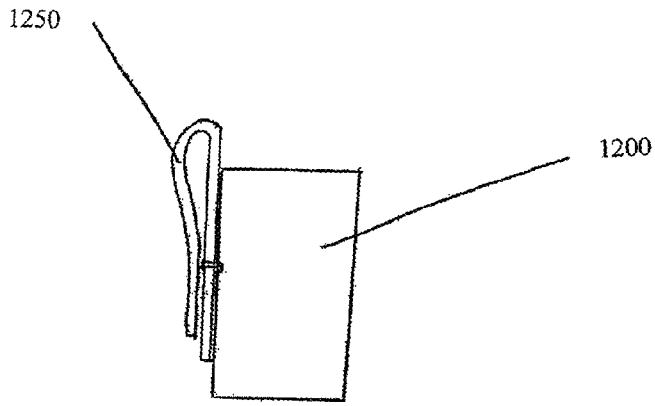
FIG. 3C shows a side elevation view of the boot stabilizer block with a clip for attachment to the boot of a rider.
Figure 3D:
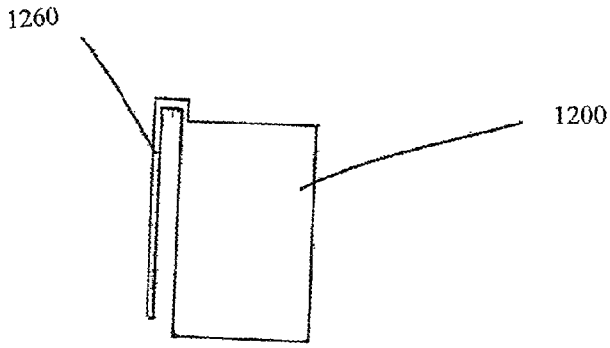
FIG. 3D shows a side elevation view of the boot stabilizer block with an overhang for slidable engagement with the boot of a rider.

The invention also provides for alternative ways to secure the boot stabilizer block 1200 to a rider. Referring to FIG. 3C, a side elevation view of the boot stabilizer block 1200 is shown where the boot stabilizer block 1200 is attached to a clip 1250 which engages the boot 1210 of a rider. FIG. 3D is a side elevation view of the boot stabilizer block 1200 having an overhang 1260 which enables sliding engagement with the boot 1210 of a rider.

Figure 4:
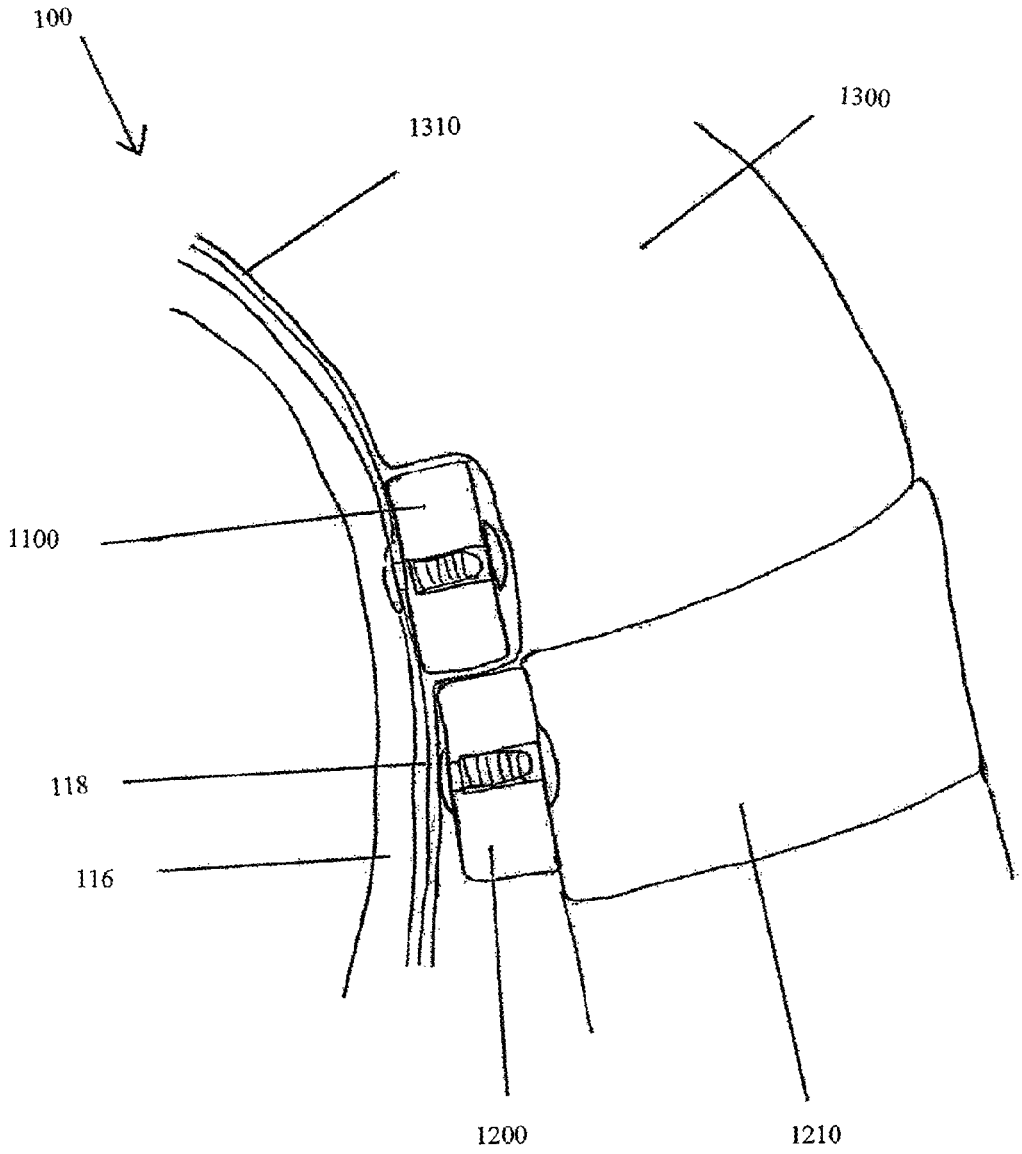
FIG. 4 shows a side elevation cross-sectional view of the saddle stabilizer block attached to the saddle engaged with the boot stabilizer block attached to the boot of a rider.

Referring to FIG. 4, a cross section of the saddle stabilizer block 1100 attached to the saddle 100 is shown in front elevation view. The saddle stabilizer block 1100 is engaged with the boot stabilizer block 1200 which is itself attached to the boot 1210 of a rider, a portion of whose leg 1300 is visible. The boot stabilizer block 1200 is directly attached to the boot 1210. The visible parts of the saddle 100 are the lower saddle flap 116, the girth billet 118, and a thin, flexible outer saddle flap 1310 facilitating engagement of the saddle stabilizer block 1100 with the boot stabilizer block 1200. When the rider is mounted in the saddle 100, the saddle stabilizer block 1100 engages the boot stabilizer block 1200 such that movement of the rider out of the saddle is restricted. This is of great benefit to both the rider and the horse. In the case of the rider, restricted upward movement results in maintenance of physical communication with the horse, ultimately resulting in the horse being more responsive to the rider. With respect to the horse, the restricted movement of the rider minimizes the force exerted on the back of the horse due to impact of the rider, for example upon completion of a jump.

Figure 5:
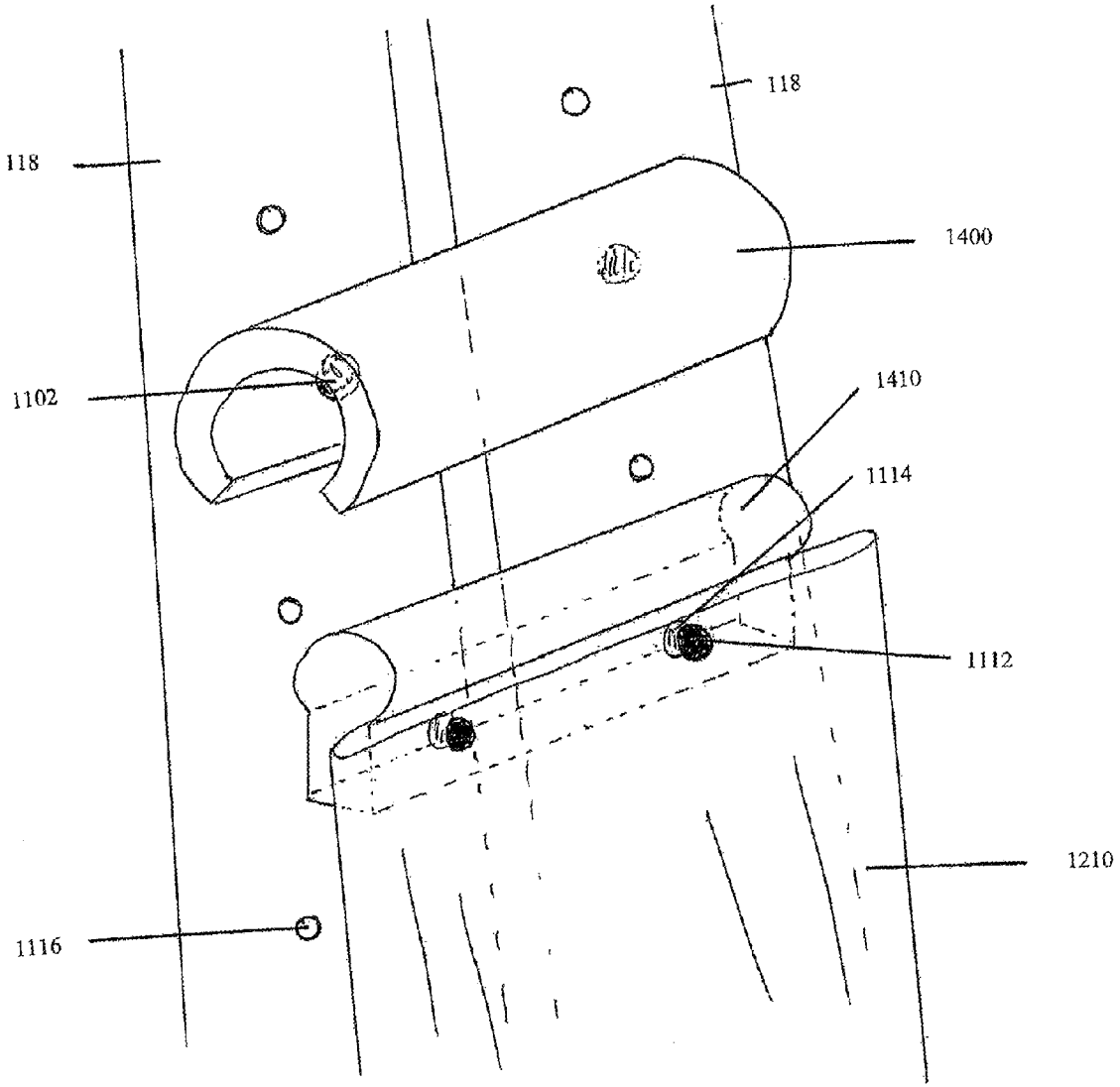
FIG. 5 shows a perspective view of an alternative embodiment of the saddle stabilizer block attached to girth billets and the boot stabilizer block attached to the boot of a rider.

Referring to FIG. 5, an alternative saddle stabilizer block 1400 is shown in perspective view that is substantially C-shaped in cross-section. An alternative boot stabilizer block 1410 has a substantially cylindrical component to enable engagement of the alternative boot stabilizer block 1410 with the alternative saddle stabilizer block 1400.

Figure 6:
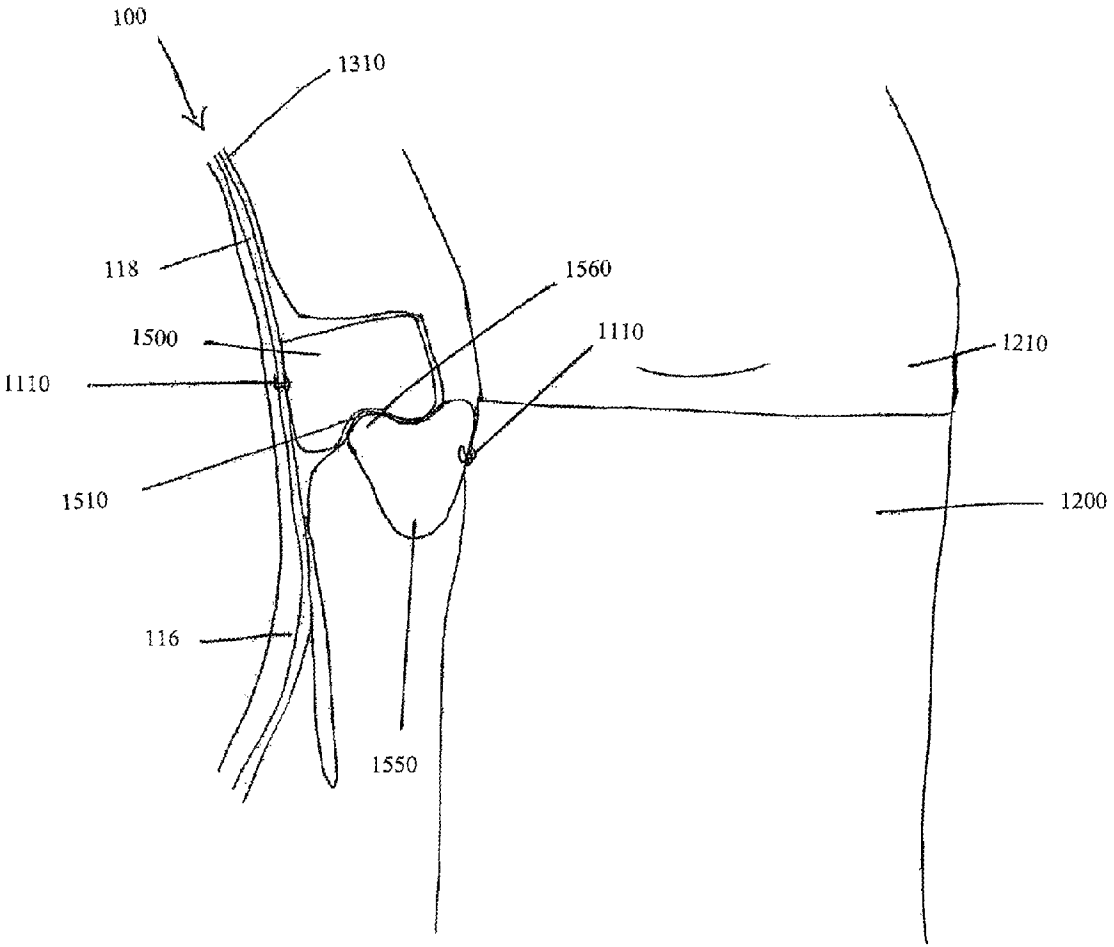
FIG. 6 shows a side elevation view of another alternative embodiment of the saddle stabilizer block attached to girth billets and the boot stabilizer block attached to the boot of a rider.

Referring to FIG. 6, an alternative saddle stabilizer block 1500 is shown in side elevation view that has an indentation 1510 along the length of one side of the alternative saddle stabilizer block 1500 to accommodate an alternative boot stabilizer block 1550 that is substantially V-shaped. A terminal end 1560 of the V-shaped boot stabilizer block 1550 is complementary in shape to the indentation 1510 of the saddle stabilizer block. The alternative saddle stabilizer block 1500 can be attached to the saddle 100 via the girth billets 118 and the alternative boot stabilizer block 1550 can be attached to the boot 1200 or lower leg 1210 of a rider as described previously.

Figure 7:
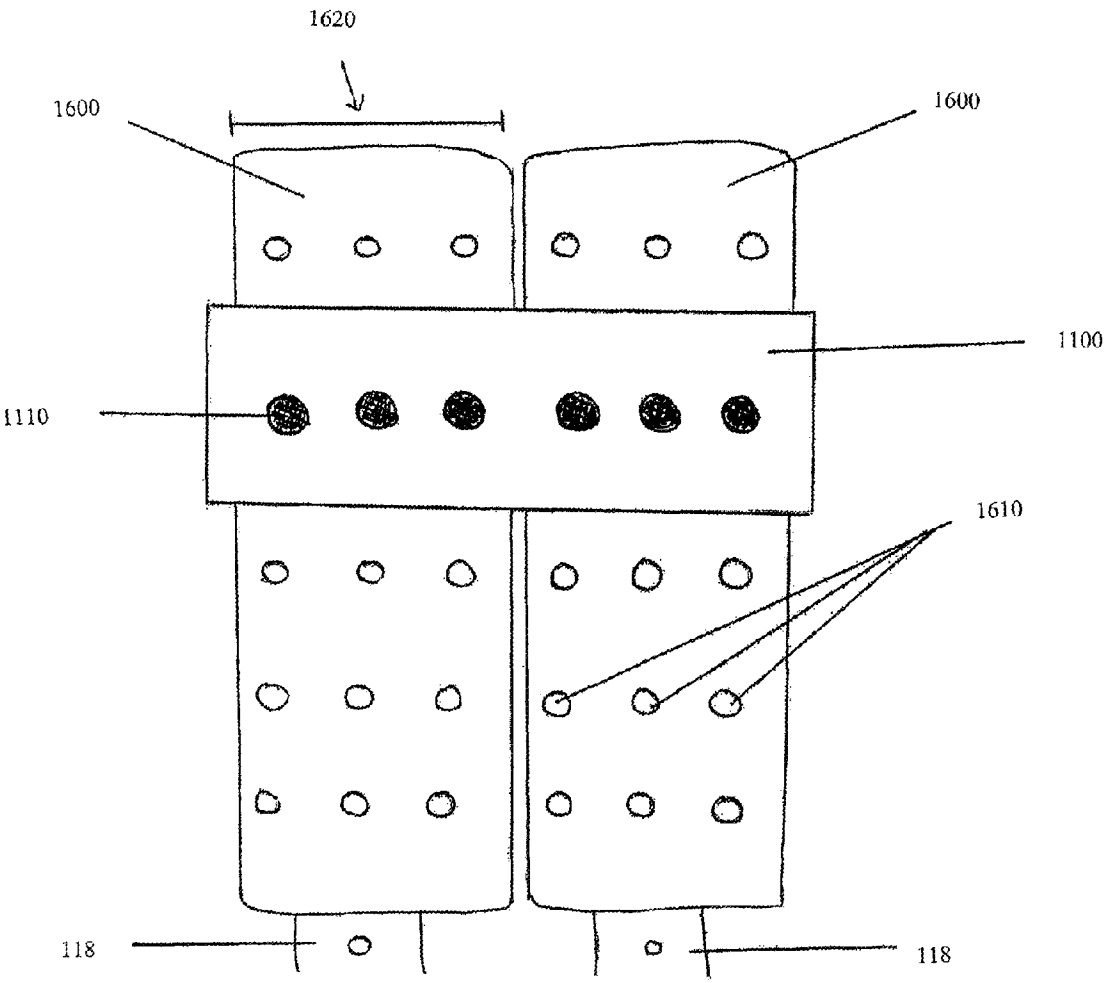
FIG. 7 shows a side elevation view of a saddle stabilizer block attached to a pair of widened girth billets.

Referring to FIG. 7, a widened girth billet 1600 attached to the girth billet 118 is shown in side elevation view. The widened girth billet 1600 has multiple apertures 1610 across the width 1620 of the widened girth billet 1600 to enable secure attachment of the saddle stabilizer block 1100 at multiple points on the widened girth billet 1620 by means of Chicago screws 1110. It would understood by a person of skill in the art that such multipoint attachment of the saddle stabilizer block 1100 to the widened girth billet 1600 provides more secure attachment of the saddle stabilizer block 1100 to the saddle 100 than is provided by standard girth billets 118.

Figure 8:
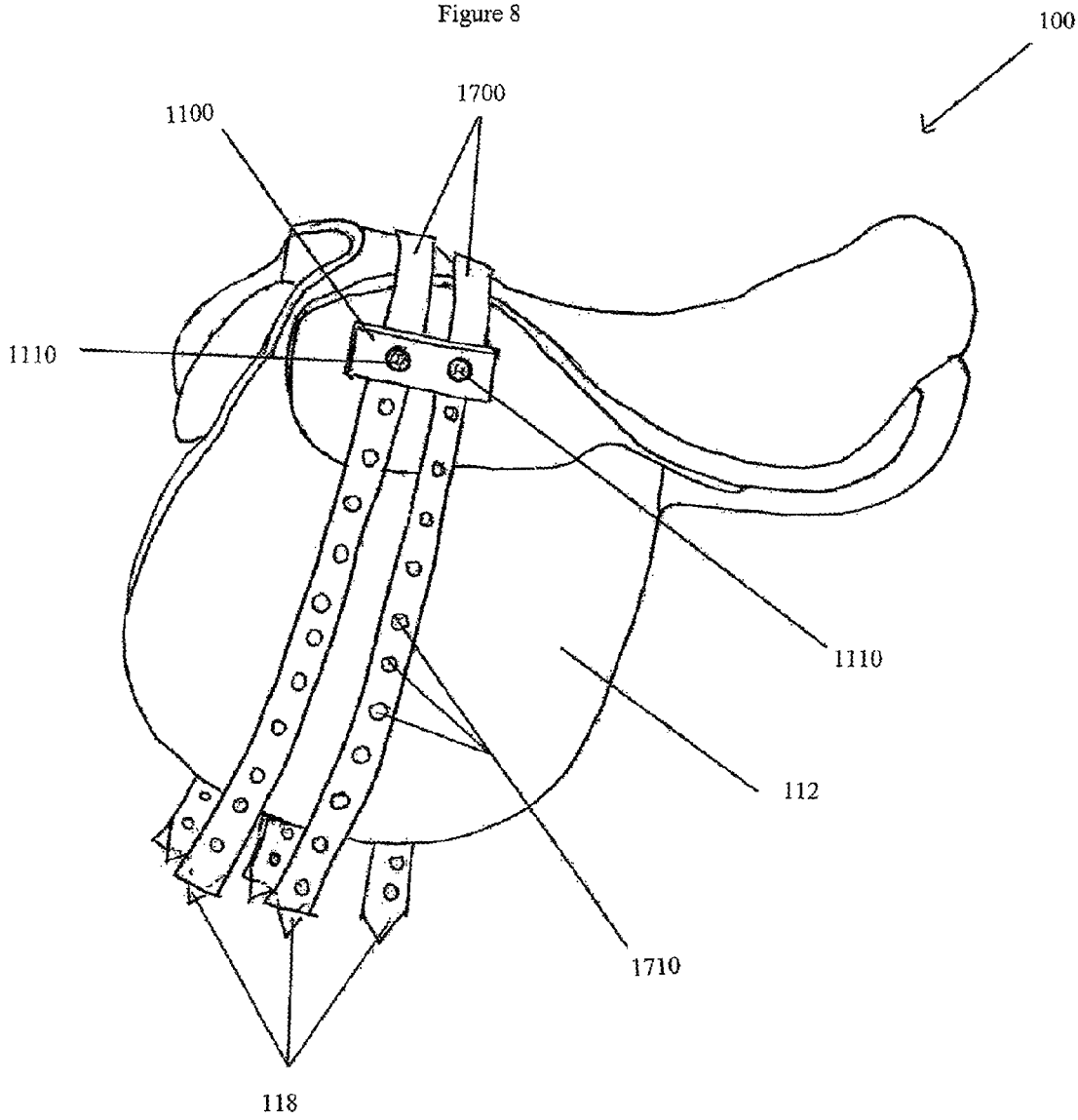
FIG. 8 shows a perspective view of the saddle stabilizer block attached to a separate set of straps.

Referring to FIG. 8, the saddle stabilizer block 1100 is shown in perspective view attached to a pair of straps 1700 by means of Chicago screws 1110. The pair of straps 1700 is attached to the saddle 100 externally. By externally is meant that the pair of straps 1700 sit on top of the saddle 100. Multiple apertures 1710 along the length of the pair of straps 1700 enable adjustable attachment of the saddle stabilizer block 1100. The pair of straps 1700 having an attached saddle stabilizer block 1100 can be placed over the top of a saddle 100 and secured to the saddle 100 by means of Chicago screws 1110 that attach the pair of straps 1700 to the girth billets 118. The external version of the saddle stabilizer block 1100 has the advantage that it can be used with any saddle where the rider requires more security in the saddle 100 and more restricted movement when riding. In addition, as the saddle stabilizer block 1100 sits outside of the outer saddle flap 112, the saddle stabilizer block 1100 can more stably engage the boot stabilizer block 1200 providing the rider with more security in the saddle 100 when riding.

While Chicago screws 1110 have been described for the current invention, it would be understood by a person of skill in the art that other fasteners could be substituted to achieve the same function in any case where a Chicago screw 1110 is used.

Figure 9:
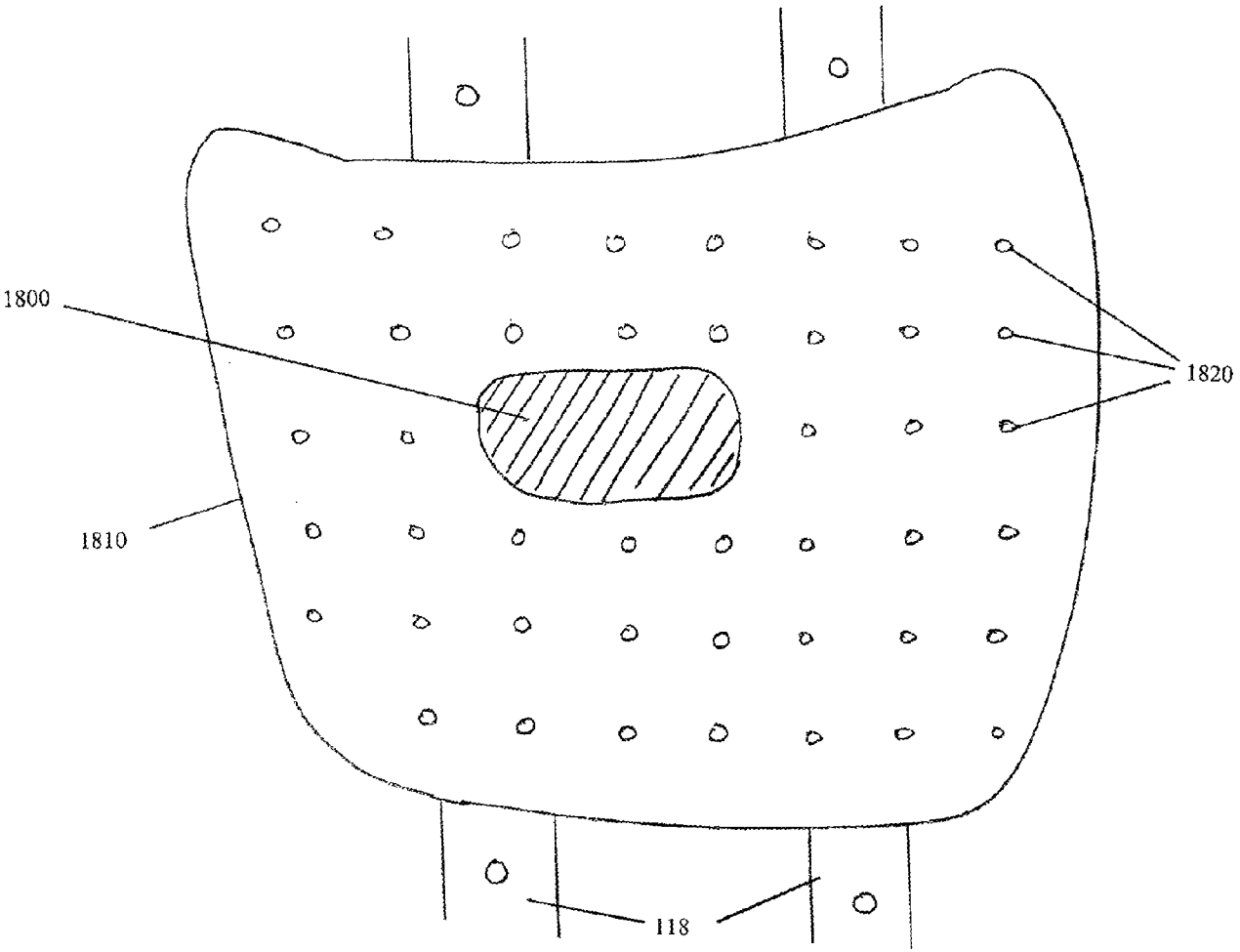
FIG. 9 shows a perspective view of the saddle stabilizer block attached to a girth plate.

Referring to FIG. 9, another embodiment is shown. Saddle stabilizer block 1800 is attached to girth plate 1810. Girth plate 1810 is attachable to girth billets 118. In this embodiment saddle stabilizer block 1800 is rounded for comfort. The girth plate 1810 is preferably made of plastic and contains a plurality of attachment points 1820. Advantageously, this embodiment allows the saddle stabilizer block 1800 to be attached at multiple positions on the saddle by attachment to different attachment points 1820. There are numerous manners in which the saddle stabilizer block 1800 can be attached to the girth plate 1810 which are known to a person skilled in the art. For example, each of the attachment points 1820 can be a bore to receive a Chicago screw. Alternatively, the attachment points 1820 can be male/female fitted to a corresponding attachment point on the saddle stabilizer block 1800. This embodiment also permits the easy attachment of multiple saddle stabilizer blocks 1800.

Although preferred embodiments of the invention have been described herein, it will be understood by those skilled in the art that variations may be made thereto without departing from the spirit of the invention or the scope of the appended claims.

What is claimed is:

1. A stabilizing system for stabilizing a rider to a saddle comprising:

a saddle having at least one saddle stabilizer block attached under a saddle flap of the saddle; and a boot stabilizer block attachable to at least one of a boot and a lower leg of the rider;

wherein the saddle stabilizer block and the boot stabilizer block engage to stabilize the rider in the saddle.

2. The stabilizing system according to claim 1 wherein the saddle stabilizer block is attached to at least one girth billet.

3. The stabilizing system according to claim 1 wherein the saddle stabilizer block is attached to the saddle using screws.

4. The stabilizing system according to claim 1 wherein the boot stabilizer block is attachable directly to the boot of the rider.

5. The stabilizing system according to claim 1 wherein the boot stabilizer block comprises a boot strap for attachment to the lower leg or boot of a rider.

6. The stabilizing system according to claim 1 wherein the saddle stabilizer block is attached to at least two girth billets.

7. The stabilizing system of claim 1, wherein the saddle further comprises a girth plate for attachment of the saddle stabilizer block to a side of the saddle.

8. The stabilizing system of claim 7, wherein the girth plate is formed from plastic.

9. The stabilizing system of claim 7, wherein the girth plate contains multiple points of attachment for the saddle stabilizer block, thereby allowing attachment of the saddle stabilizer block at multiple positions on the side of the saddle.

* * * * *